US011011330B2

(12) United States Patent
Lee et al.

(10) Patent No.: US 11,011,330 B2
(45) Date of Patent: May 18, 2021

(54) KEYBOARD DEVICE

(71) Applicant: Primax Electronics Ltd., Taipei (TW)

(72) Inventors: Yi-Shu Lee, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/725,060

(22) Filed: Dec. 23, 2019

(65) Prior Publication Data

US 2021/0098211 A1 Apr. 1, 2021

(30) Foreign Application Priority Data

Sep. 26, 2019 (TW) ..... 108134884

(51) Int. Cl.
*H01H 13/85* (2006.01)
*H01H 13/7065* (2006.01)

(52) U.S. Cl.
CPC ..... *H01H 13/85* (2013.01); *H01H 13/7065* (2013.01); *H01H 2215/03* (2013.01)

(58) Field of Classification Search
CPC . H01H 13/85; H01H 13/7065; H01H 2215/03
USPC ..... 200/5 A, 344
See application file for complete search history.

(56) References Cited

U.S. PATENT DOCUMENTS

2011/0303521 A1* 12/2011 Niu ..... H01H 3/125 200/517
2015/0170854 A1* 6/2015 Nishino ..... H01H 13/14 200/5 A

* cited by examiner

*Primary Examiner* — Edwin A. Leon
*Assistant Examiner* — Iman Malakoot
(74) *Attorney, Agent, or Firm* — Kirton McConkie; Evan R. Witt

(57) ABSTRACT

A keyboard device includes a membrane circuit board, a base plate and a key structure. The base plate is located under the membrane circuit board. The key structure includes a lever structure, a resilience element or an interference structure. While the keycap is depressed, the lever structure, the resilience element or the interference structure collides with a keycap of the key structure, the base plate or a connecting element of the key structure. Consequently, the operating sound is generated, and the operating feedback is provided to the user.

15 Claims, 14 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users pay much attention to the keyboard devices.

Hereinafter, the structure and function of a conventional keyboard device with a mechanical key structure will be described with reference to FIGS. 1 and 2. FIG. 1 is a schematic cross-sectional view illustrating a conventional keyboard device with a mechanical key structure. FIG. 2 is a schematic cross-sectional view illustrating the mechanical switch of the conventional keyboard device of FIG. 1, in which a keycap of the mechanical key structure is depressed. For succinctness, only one mechanical key structure and associated components are shown in FIGS. 1 and 2. The keyboard device 2 comprises plural mechanical key structures 22 and a circuit board 21. Each mechanical key structure 22 comprises a keycap 221 and a mechanical switch 224. The mechanical switch 224 is arranged between the keycap 221 and the circuit board 21. The mechanical switch 224 comprises a casing 2241, a push element 2242, a linkage element 2243, a first spring strip 2244, a second spring strip 2245 and an elastic element 2246. The linkage element 2243, the elastic element 2246, at least a part of the push element 2242, at least a part of the first spring strip 2244 and at least a part of the second spring strip 2245 are accommodated within the casing 2241.

The casing 2241 comprises a pedestal 22411 and an upper cover 22412. The pedestal 22411 is covered by the upper cover 22412. Moreover, the upper cover 22412 has an upper cover opening 22413. A first end of the push element 2242 is penetrated through the upper cover opening 22413 and contacted with the keycap 221. A second end of the push element 2242 is disposed within the casing 2241 and connected with the linkage element 2243. The linkage element 2243 is located at a middle region of the pedestal 22411. Moreover, the linkage element 2243 is movable upwardly or downwardly relative to the pedestal 22411. The linkage element 2243 has a protrusion structure 22431. The protrusion structure 22431 is extended from a sidewall of the linkage element 2243 and toward the first spring strip 2244. The elastic element 2246 is located under the linkage element 2243. A first end of the elastic element 2246 is connected with the linkage element 2243. A second end of the elastic element 2246 is fixed on the pedestal 22411. Moreover, the elastic element 2246 provides an elastic force to the linkage element 2243.

The first spring strip 2244 is located near a sidewall of the pedestal 22411. The first spring strip 2244 comprises a first electric connection part 22441, an elastic part 22442 and a first fixing part 22443. The first fixing part 22443 is fixed on the pedestal 22411. Moreover, the first fixing part 22443 is arranged between the first electric connection part 22441 and the elastic part 22442. The elastic part 22442 is disposed within the casing 2241 and contacted with the protrusion structure 22431 of the linkage element 2243. Moreover, the elastic part 22442 can be swung relative to the first fixing part 22443. After the first electric connection part 22441 is penetrated downwardly through the pedestal 22411, the first electric connection part 22441 is contacted and electrically connected with the circuit board 21. The second spring strip 2245 is arranged between the linkage element 2243 and the first spring strip 2244. The second spring strip 2245 comprises a second electric connection part 22451, a conduction part 22452 and a second fixing part 22453. The second fixing part 22453 is fixed on the pedestal 22411. Moreover, the second fixing part 22453 is arranged between the second electric connection part 22451 and the conduction part 22452. The conduction part 22452 is disposed within the casing 2241. After the second electric connection part 22451 is penetrated downwardly through the pedestal 22411, the second electric connection part 22451 is contacted and electrically connected with the circuit board 21.

While the keycap 221 is depressed, the keycap 221 is moved downwardly to push the push element 2242. Since the linkage element 2243 is connected with the push element 2242, the linkage element 2243 is moved downwardly with the push element 2242. At the same time, the elastic element 2246 is compressed to generate the elastic force. As the linkage element 2243 is moved downwardly, the protrusion structure 22431 of the linkage element 2243 is contacted with the elastic part 22442 of the first spring strip 2244. Moreover, the protrusion structure 22431 is moved downwardly relative to the elastic part 22442 so as to push the elastic part 22442. Consequently, the elastic part 22442 is swung relative to the first fixing part 22443. As the linkage element 2243 is continuously moved downwardly, the swung elastic part 22442 correspondingly contacts and collides with the conduction part 22452 of the second spring strip 2245. Meanwhile, as shown in FIG. 2, the first spring strip 2244 and the second spring strip 2245 are in contact with each other. Consequently, the circuit board 21 generates a corresponding key signal.

When the elastic part 22442 of the first spring strip 2244 collides with the conduction part 22452 of the second spring strip 2245, a click sound is generated. Due to the click sound, the user can feel the feedback of depressing the keycap 221. Moreover, when the keycap 221 is no longer depressed, the linkage element 2243 and the push element 2242 are moved upwardly in response to the elastic force of the elastic element 2246. Consequently, the keycap 221 is returned to its original position as shown in FIG. 1. The operations of the mechanical switch 224 are well known to those skilled in the art, and are not redundantly described herein. The type of the mechanical switch 224 is not restricted to that of FIGS. 1 and 2.

However, the mechanical switch still has some drawbacks. For example, since the structure of the mechanical switch is complicated, the fabricating cost of the mechanical switch is high. Moreover, it is difficult to reduce the thickness of the keyboard device with the mechanical switch. That is, the keyboard device with the mechanical switch cannot meet the requirements of light weightiness, slimness and small size. For solving these drawbacks, a keyboard device with a membrane switch has been introduced into the market.

Please refer to FIGS. 3 and 4. FIG. 3 is a schematic side view illustrating a conventional keyboard device with a membrane switch. FIG. 4 is a schematic exploded view illustrating a portion of a membrane circuit board of the conventional keyboard device of FIG. 3. The conventional keyboard device 1 comprises a base plate 13, a membrane circuit board 14 and plural key structures 12. Each of the plural key structures 12 comprises a keycap 121, a scissors-type connecting element 122 and an elastic element 123. The scissors-type connecting element 122 is connected between the keycap 121 and the base plate 13. Moreover, the scissors-type connecting element 122 comprises a first frame 1221 and a second frame 1222. The second frame 1222 is pivotally coupled to the first frame 1221. Consequently, the first frame 1221 and the second frame 1222 can be swung relative to each other. The elastic element 123 is arranged between the keycap 121 and the membrane circuit board 14. Moreover, the elastic element 123 comprises a contacting part 1231.

The membrane circuit board 14 comprises an upper film layer 142, a lower film layer 141 and an intermediate film layer 143. The intermediate film layer 143 is arranged between the upper film layer 142 and the lower film layer 141. A first circuit pattern 1421 is formed on a bottom surface of the upper film layer 142. The first circuit pattern 1421 comprises plural upper contacts 14211 corresponding to the plural key structures 12. A second circuit pattern 1411 is formed on a top surface of the lower film layer 141. The second circuit pattern 1411 comprises plural lower contacts 14111 corresponding to the plural upper contacts 14211. In addition, the intermediate film layer 143 comprises plural perforations 1431 corresponding to the plural upper contacts 14211 and the plural lower contacts 14111. Each of the upper contacts 14211 and the corresponding lower contact 14111 are collectively defined as a membrane switch 144.

While the keycap 121 of any key structure 12 is depressed and moved downwardly relative to the base plate 11, the first frame 1221 and the second frame 1222 of the scissors-type connecting element 122 are switched from an open-scissors state to a stacked state. Moreover, as the keycap 121 is moved downwardly to compress the elastic element 123, the corresponding upper contact 14211 is contacted with and triggered by the contacting part 1231 of the elastic element 123. Consequently, the corresponding upper contact 14211 is penetrated through the corresponding perforation 1431 and contacted with the corresponding lower contact 14111. Under this circumstance, the corresponding membrane switch 144 is electrically conducted. When the keycap 121 of the key structure 12 is no longer depressed, the keycap 121 is moved upwardly relative to the base plate 11 in response to an elastic force of the elastic element 123. Meanwhile, the first frame 1221 and the second frame 1222 are switched from the stacked state to the open-scissors state again, and the keycap 121 is returned to its original position.

As mentioned above, the keyboard device with the membrane switch is slim, and the fabricating cost is reduced. However, unlike the mechanical switch, the depressing action on the membrane switch cannot generate the click sound. That is, the user cannot feel the feedback of depressing the keycap. Consequently, the conventional keyboard device needs to be further improved.

SUMMARY OF THE INVENTION

An object of the present invention provides a keyboard device. A key structure of the keyboard device includes a lever structure. While a keycap of the key structure is moved downwardly, the lever structure is moved upwardly to collide with the keycap. Consequently, the operating sound and the operating feedback like a mechanical switch are generated.

Another object of the present invention provides a keyboard device. A key structure of the keyboard device includes a resilience element. While a keycap of the keyboard device is depressed to push the connecting element, the resilience element is moved downwardly to collide with the base plate. Consequently, the operating sound and the operating feedback like a mechanical switch are generated.

A further object of the present invention provides a keyboard device. A key structure of the keyboard device includes an interference structure. While the keycap is depressed, the head part and the connecting element interfere with each other. Consequently, the operating sound and the operating feedback like a mechanical switch are generated.

In accordance with an aspect of the present invention, a keyboard device is provided. The keyboard device includes a membrane circuit board, a base plate and a key structure. The membrane circuit board includes a membrane switch. The base plate is located under the membrane circuit board. The key structure includes a keycap, a connecting element and a lever structure. The keycap is located over the membrane circuit board. The connecting element is connected between the base plate and the keycap. The keycap is movable upwardly or downwardly relative to the base plate through the connecting element. The lever structure is located under the keycap, and includes a lever body, a first lever end, a second lever end and a fulcrum. The first lever end, the second lever end and the fulcrum are connected with the lever body. The first lever end is protruded upwardly from a first lateral side of the lever body. The second lever end is protruded upwardly from a second lateral side of the lever body. The fulcrum is arranged between the first lever end and the second lever end. The fulcrum is protruded downwardly from the lever body and contacted with the membrane circuit board or the base plate. While the keycap is depressed and the connecting element is moved downwardly to push the first lever end, the second lever end is moved upwardly to collide with the keycap.

In accordance with another aspect of the present invention, a keyboard device is provided. The keyboard device includes a membrane circuit board, a base plate and a key structure. The membrane circuit board includes a membrane switch. The base plate is located under the membrane circuit board. The key structure includes a keycap, a connecting element and a resilience element. A first end part of the resilience element is fixedly connected with the connecting element. While the keycap is depressed to push the connecting element, a second end part of the resilience element is moved downwardly to collide with the base plate.

In accordance with a further aspect of the present invention, a keyboard device is provided. The keyboard device includes a membrane circuit board, a base plate and a key structure. The membrane circuit board includes a membrane switch. The base plate is located under the membrane circuit board. The key structure includes a keycap, a connecting element and an interference structure. The interference structure is located under the keycap, and includes a spring part and a head part. A first end of the spring part is contacted with the membrane circuit board or the base plate. A second end of the spring part is connected with the head part. While the keycap is depressed, the head part and the connecting element interfere with each other, so that an operating sound is generated.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
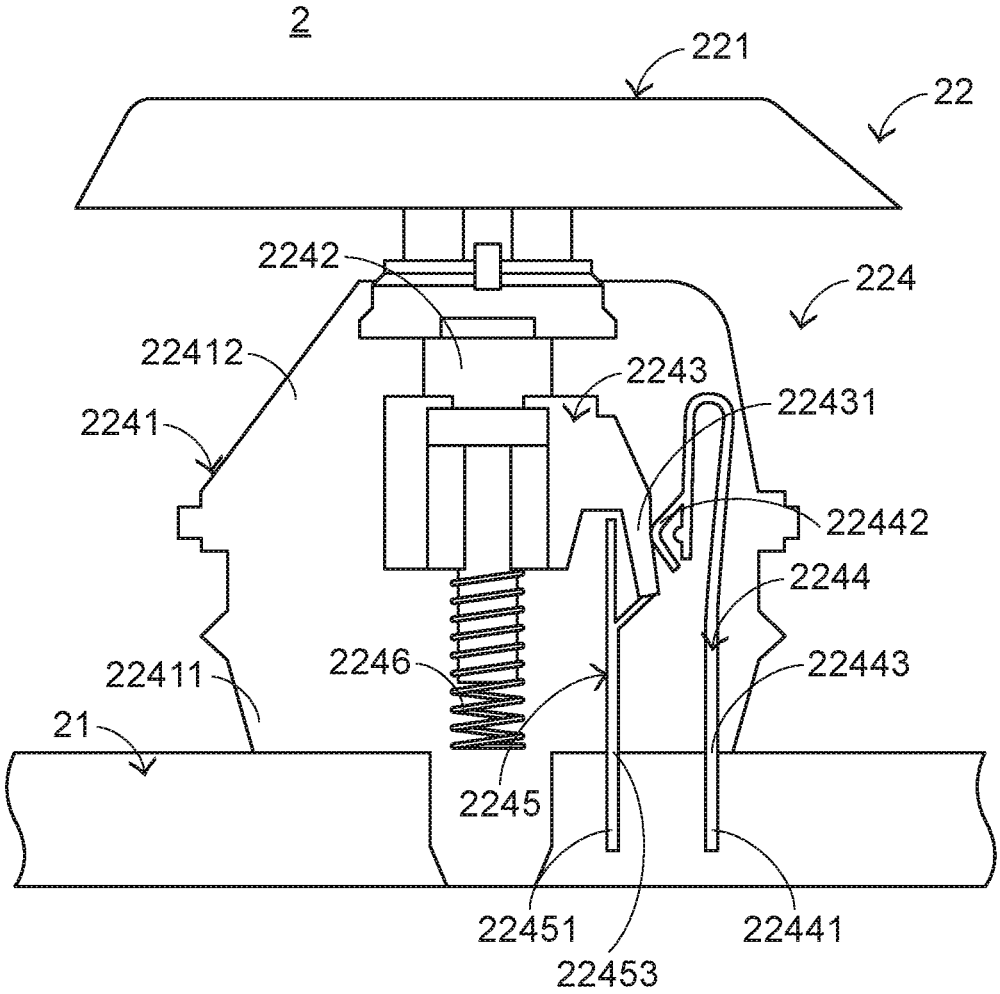
FIG.1 PRIOR ART
FIG. 1 is a schematic cross-sectional view illustrating a conventional keyboard device with a mechanical key structure.
Figure 2:
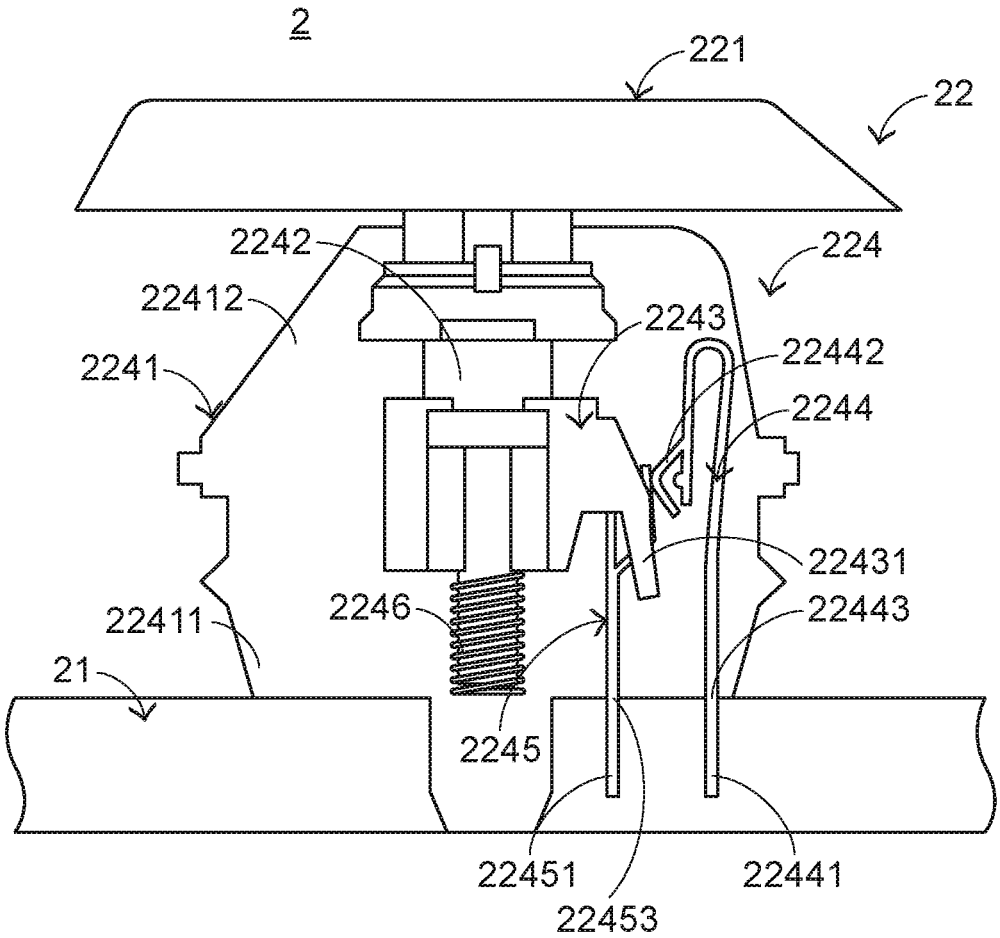
FIG.2 PRIOR ART
FIG. 2 is a schematic cross-sectional view illustrating the mechanical switch of the conventional keyboard device of FIG. 1, in which a keycap of the mechanical key structure is depressed.
Figure 3:
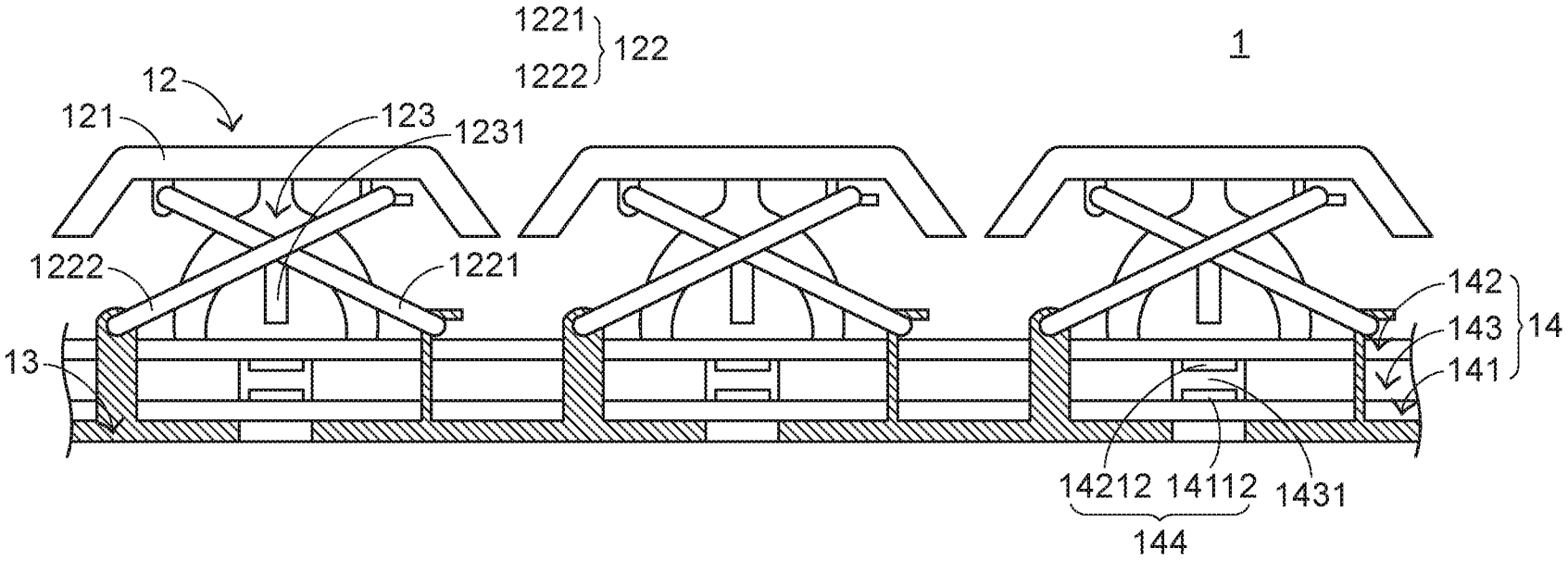
FIG.3 PRIOR ART
FIG. 3 is a schematic side view illustrating a conventional keyboard device with a membrane switch.
Figure 4:
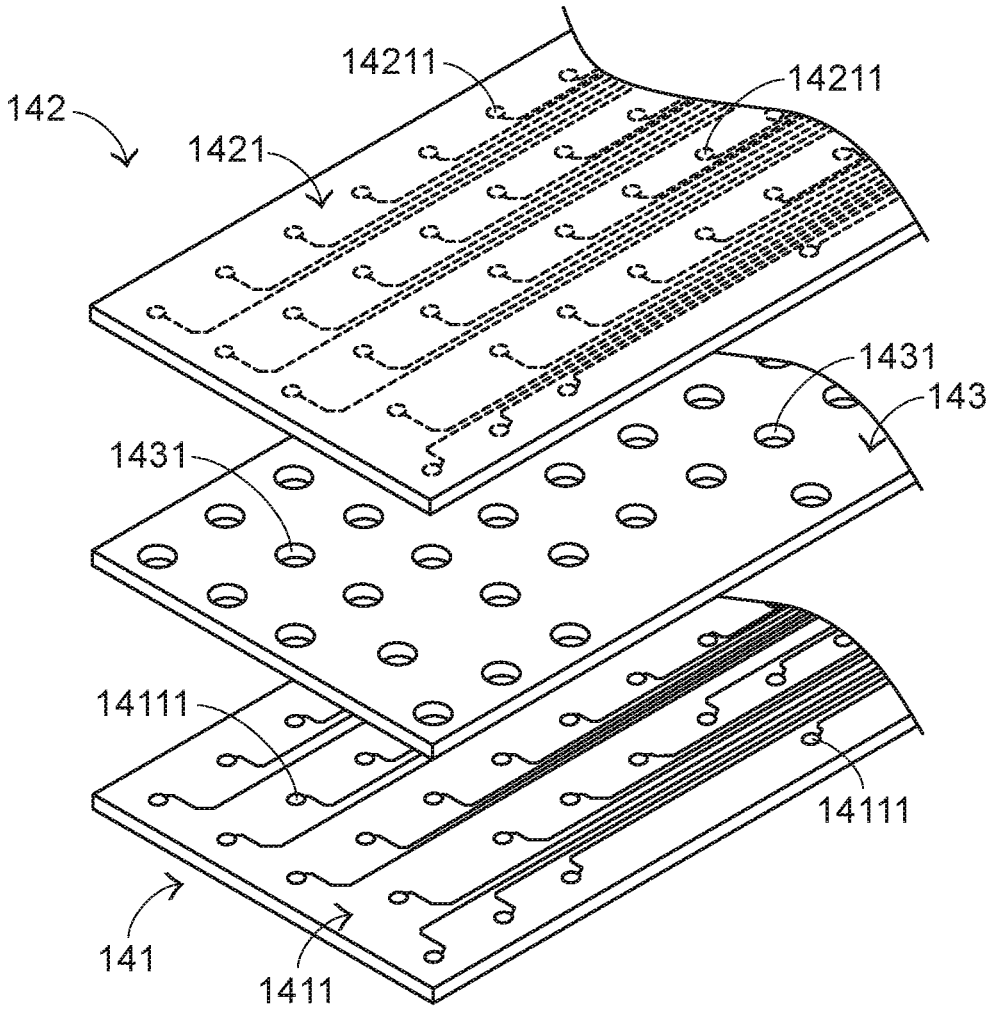
FIG.4 PRIOR ART
FIG. 4 is a schematic exploded view illustrating a portion of a membrane circuit board of the conventional keyboard device of FIG. 3.

The embodiments of present invention will be described more specifically with reference to the following drawings. Generally, in the drawings and specifications, identical or similar components are designated by identical numeral references. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 5:
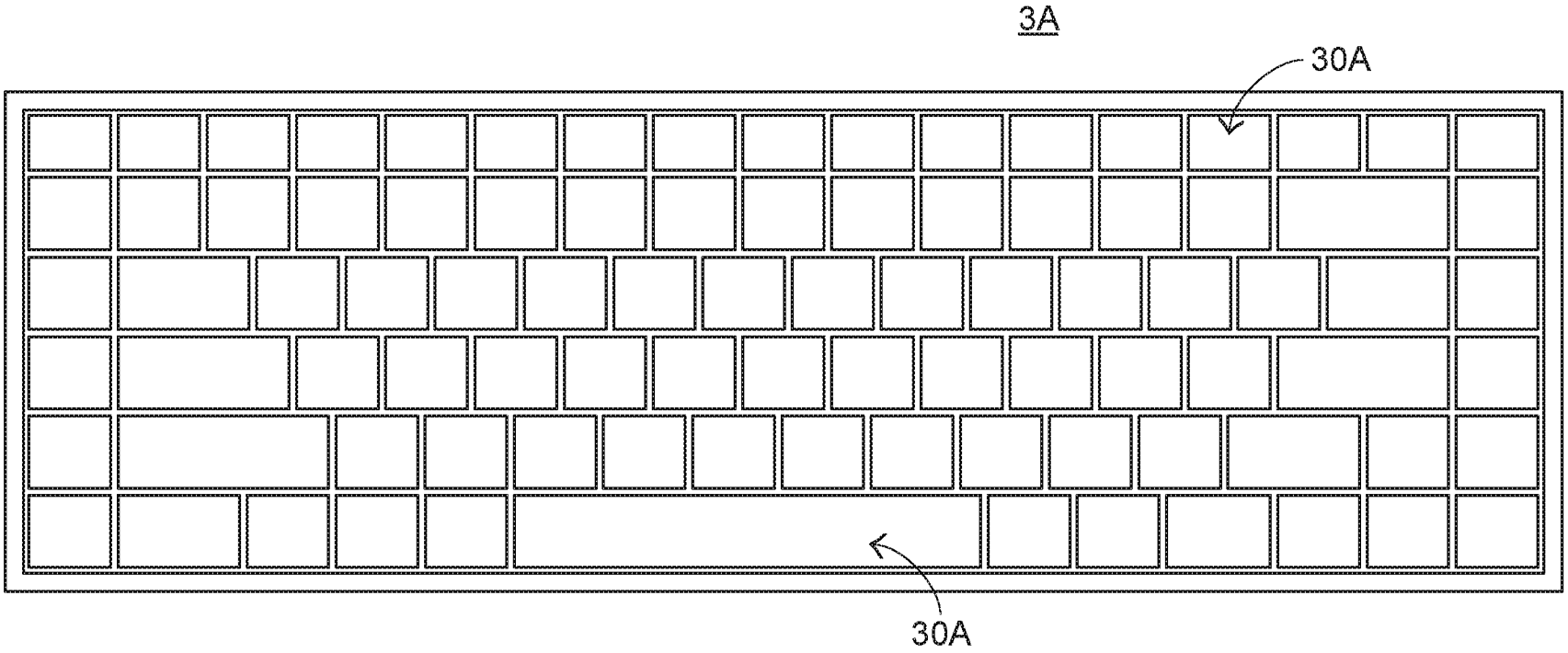
FIG. 5 is a schematic top view illustrating a keyboard device according to a first embodiment of the present invention.
Figure 6:
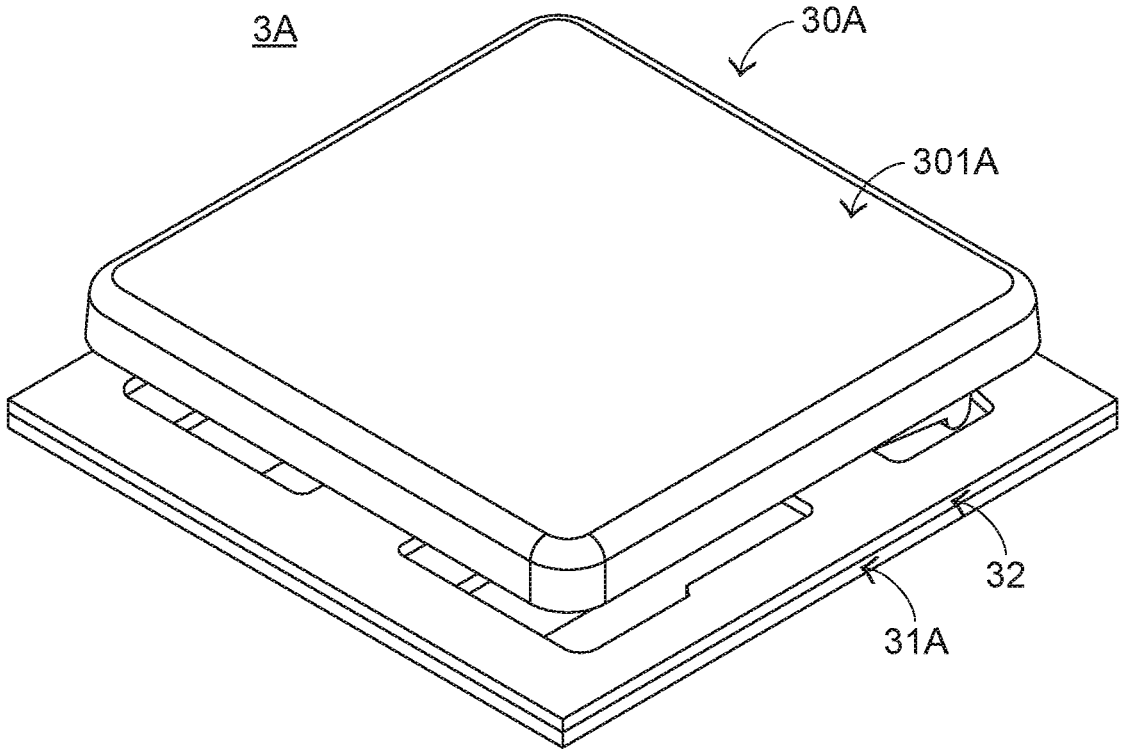
FIG. 6 is a schematic perspective view illustrating a portion of the keyboard device as shown in FIG. 5.

Please refer to FIGS. 5 and 6. FIG. 5 is a schematic top view illustrating a keyboard device according to a first embodiment of the present invention. FIG. 6 is a schematic perspective view illustrating a portion of the keyboard device as shown in FIG. 5. For succinctness, only one key structure is shown in FIG. 6. The keyboard device 3A comprises plural key structures 30A, a base plate 31A and a membrane circuit board 32. The membrane circuit board 32 is disposed on the base plate 31A. These key structures 30A are classified into some types, e.g., ordinary keys, numeric keys and function keys. When one of the key structures 30A is depressed by the user's finger, the keyboard device 3A generates a corresponding key signal to the computer, and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Figure 7:
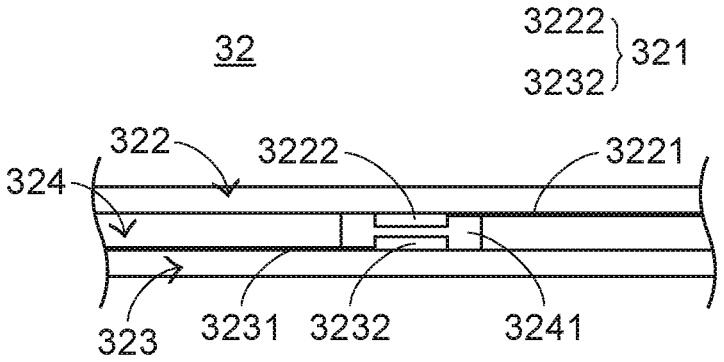
FIG. 7 is a schematic cross-sectional view illustrating the membrane circuit board of the keyboard device as shown in FIG. 6.

The membrane circuit board 32 comprises plural film layers. The plural film layers of the membrane circuit board 32 are arranged in a stack form. FIG. 7 is a schematic cross-sectional view illustrating the membrane circuit board of the keyboard device as shown in FIG. 6. The membrane circuit board 32 comprises plural film layers. The thickness of each film layer is presented herein for purpose of illustration and description only. For succinctness, only one upper contact, one lower contact and one perforation are shown in FIG. 7. In this embodiment, the membrane circuit board 32 comprises an upper film layer 322 and a lower film layer 323. A first circuit pattern 3221 is formed on a bottom surface of the upper film layer 322. The first circuit pattern 3221 comprises plural upper contacts 3222 corresponding to the plural key structures 30A. A second circuit pattern 3231 is formed on a top surface of the lower film layer 323. The second circuit pattern 3231 comprises plural lower contacts 3232 corresponding to the plural upper contacts 3222. Each of the upper contacts 3222 and the corresponding lower contact 3232 are separated from each other by a spacing interval. Moreover, each of the upper contacts 3222 and the corresponding lower contact 3232 are collectively defined as a membrane switch 321. For maintaining the spacing interval between each upper contact 3222 and the corresponding lower contact 3232, the membrane circuit board 32 further comprises an intermediate film layer 324. The intermediate film layer 324 is arranged between the upper film layer 322 and the lower film layer 323. In addition, the intermediate film layer 324 comprises plural perforations 3241 corresponding to the plural upper contacts 3222 and the plural lower contacts 3232. Preferably but not exclusively, at least one of the upper film layer 322, the lower film layer 323 and the intermediate film layer 324 is made of polycarbonate (PC), polyethylene terephthalate (PET), polymethylmethacrylate (PMMA), polyurethane (PU) or polyimide (PI).

Figure 8:
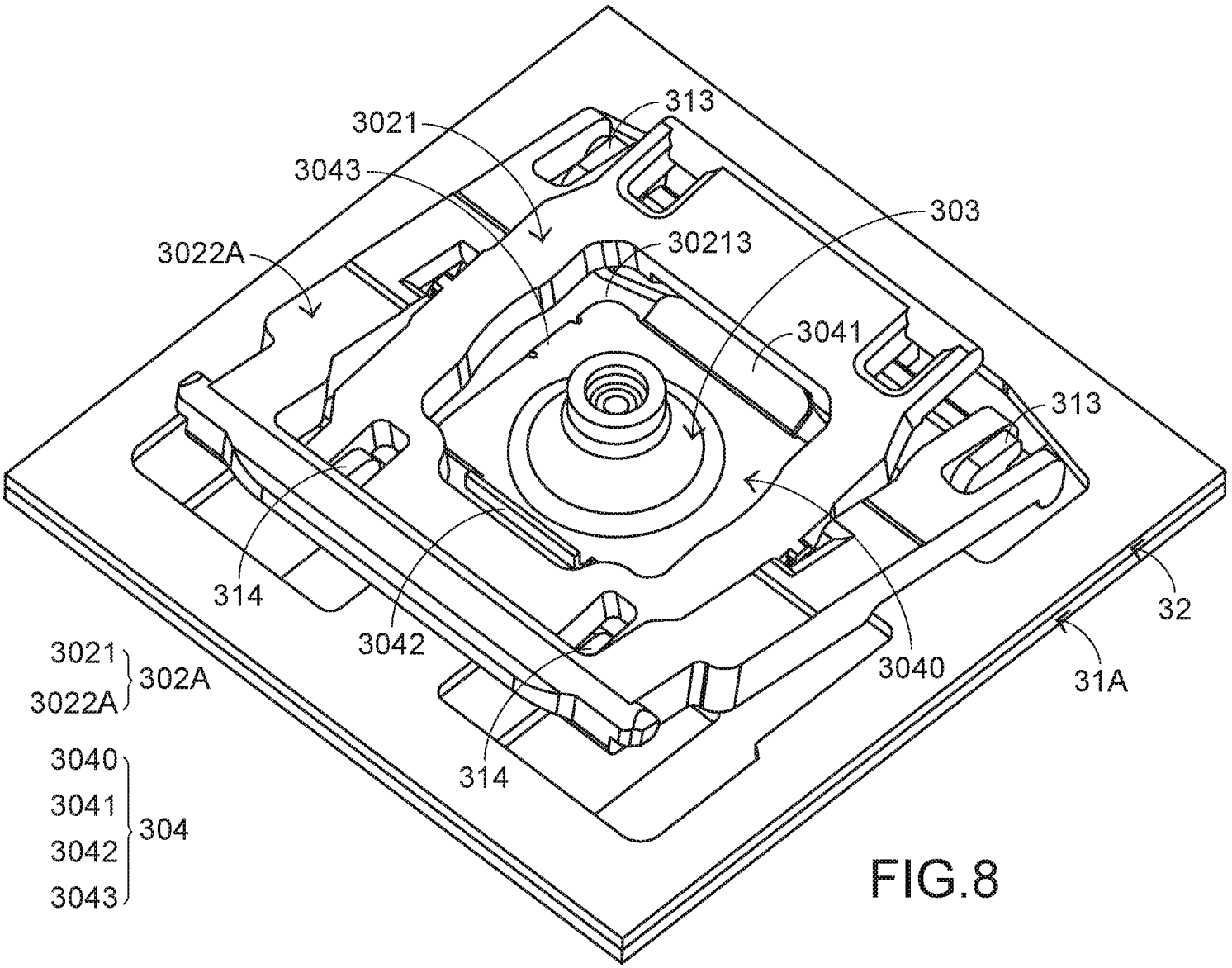
FIG. 8 is a schematic perspective view illustrating a portion of the keyboard device as shown in FIG. 6.
Figure 9A:
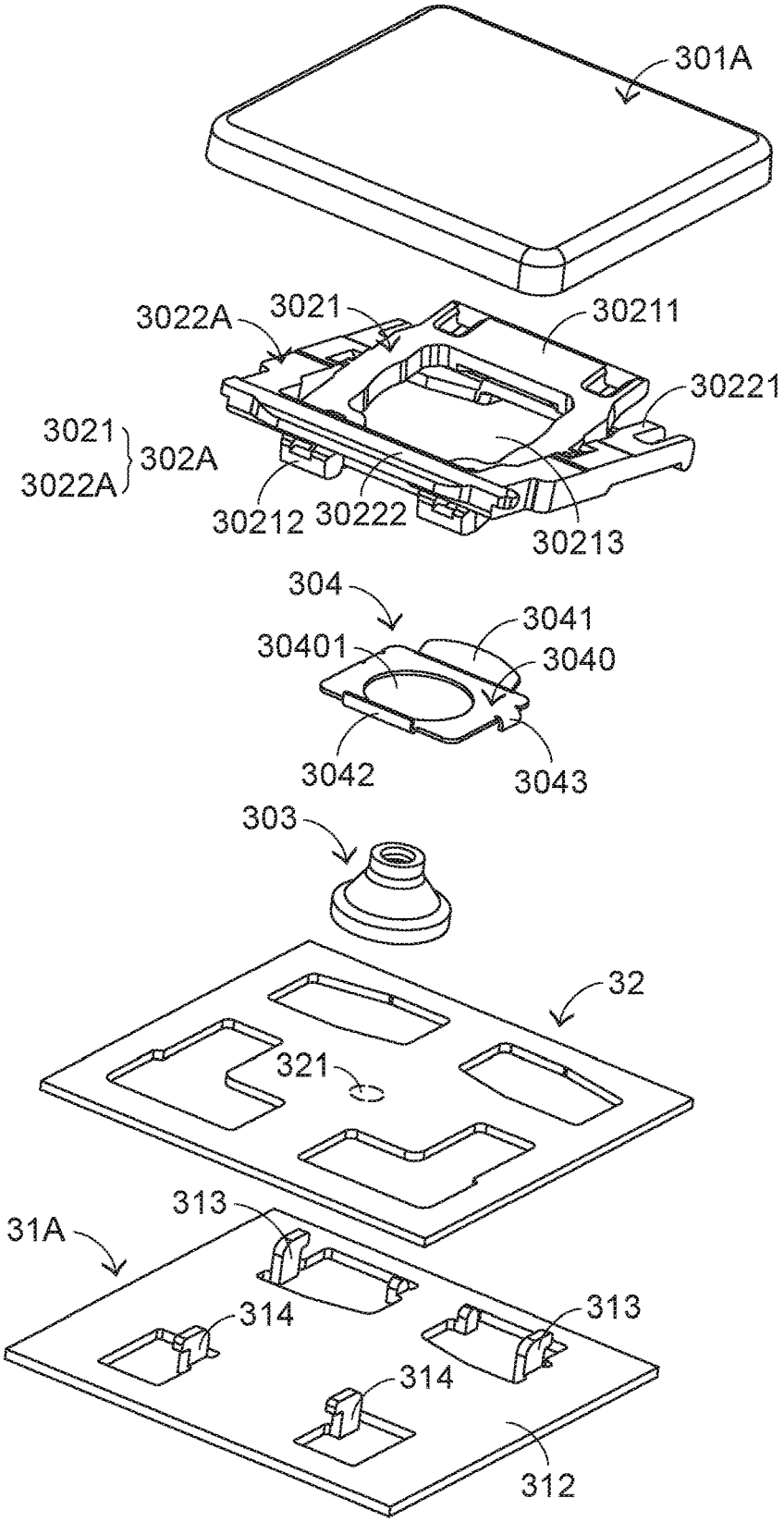
FIG. 9A is a schematic exploded view illustrating a portion of the keyboard device as shown in FIG. 6 and taken along a viewpoint.
Figure 9B:
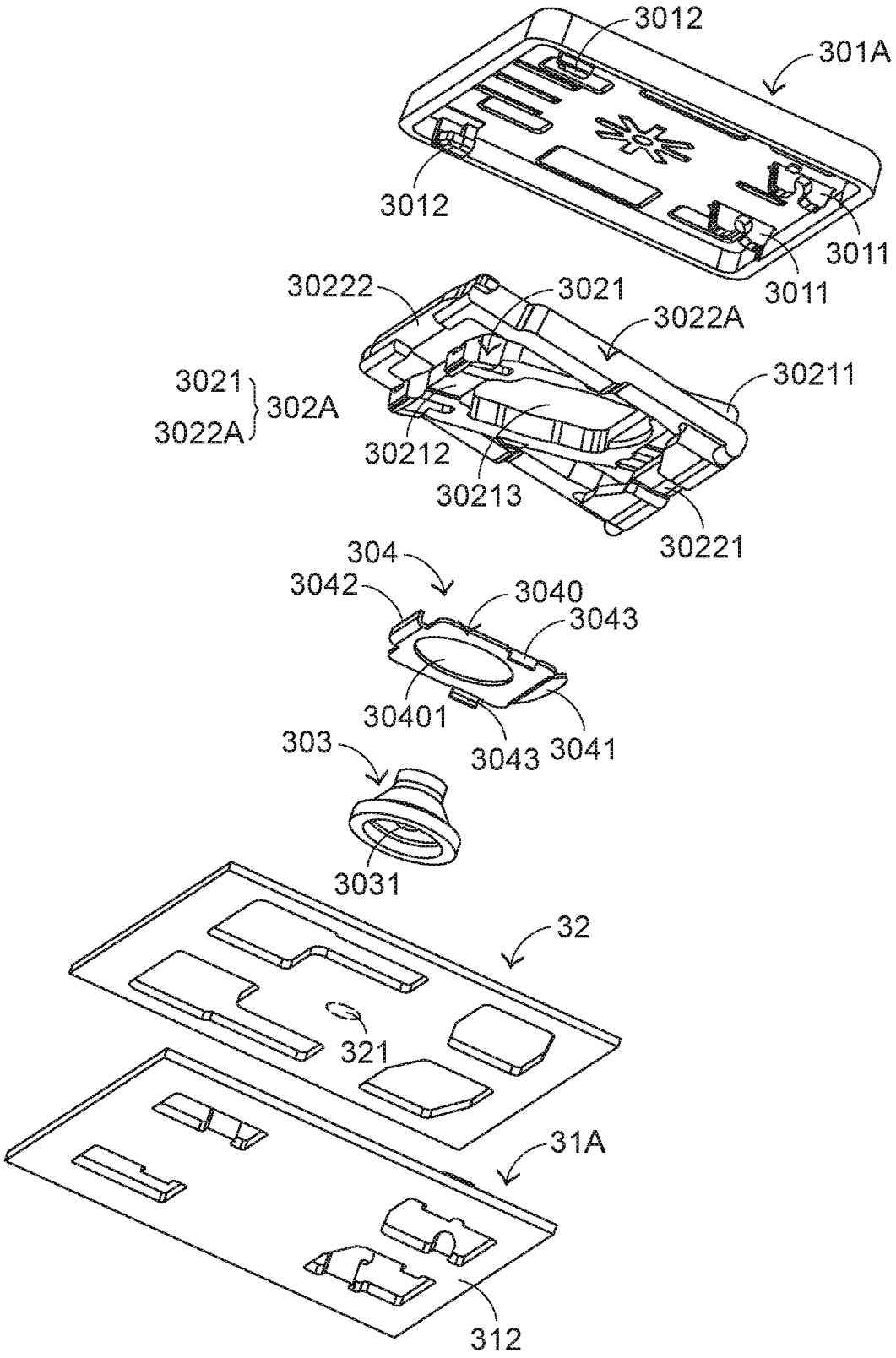
FIG. 9B is a schematic exploded view illustrating a portion of the keyboard device as shown in FIG. 6 and taken along another viewpoint.
Figure 10:
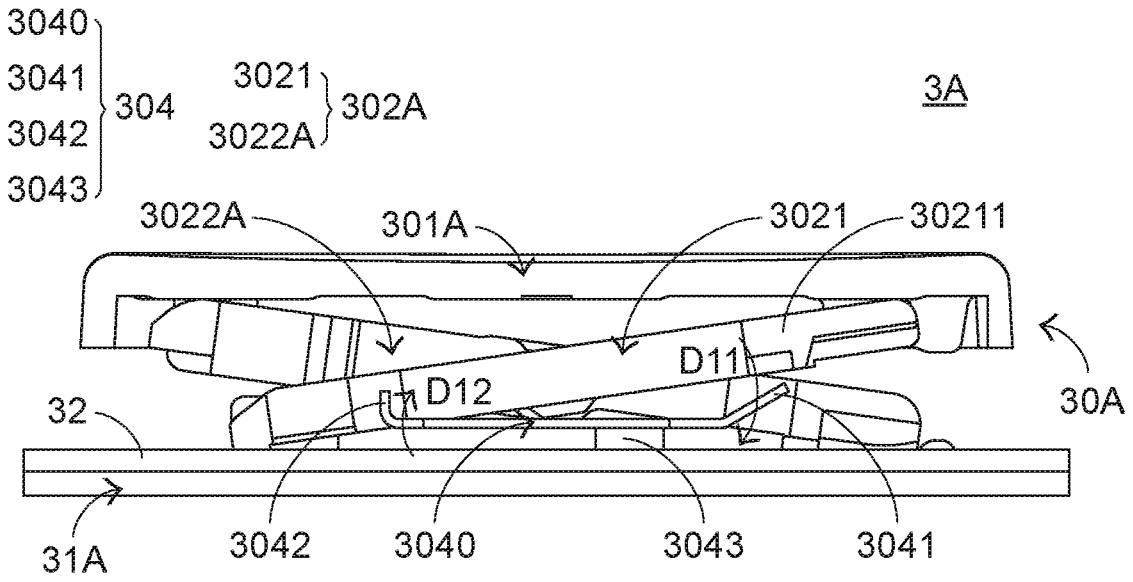
FIG. 10 is a schematic side view illustrating a portion of the keyboard device as shown in FIG. 6.

Please refer to FIGS. 8, 9A, 9B and 10. FIG. 8 is a schematic perspective view illustrating a portion of the keyboard device as shown in FIG. 6. FIG. 9A is a schematic exploded view illustrating a portion of the keyboard device as shown in FIG. 6 and taken along a viewpoint. FIG. 9B is a schematic exploded view illustrating a portion of the keyboard device as shown in FIG. 6 and taken along another viewpoint. FIG. 10 is a schematic side view illustrating a portion of the keyboard device as shown in FIG. 6. For succinctness, only one key structure and the related components are shown in FIGS. 8, 9A, 9B and 10. In practice, the keyboard device comprises more than one key structure.

Each key structure 30A comprises a keycap 301A, a connecting element 302A, an elastic element 303 and a lever structure 304. The connecting element 302 is connected between the keycap 301A and the base plate 31A. The keycap 301A is movable upwardly or downwardly relative to the base plate 31A through the connecting element 302A.

The elastic element 303 is arranged between the keycap 301A and the membrane circuit board 32. Moreover, the elastic element 303 comprises a contacting part 3031. The lever structure 304 is located under the keycap 301A. The lever structure 304 comprises a lever body 3040, a first lever end 3041, a second lever end 3042 and a fulcrum 3043. The first lever end 3041, the second lever end 3042 and the fulcrum 3043 are connected with the lever body 3040. The first lever end 3041 and the second lever end 3042 are protruded upwardly from two lateral sides of the lever body 3040, respectively. The fulcrum 3043 is arranged between the first lever end 3041 and the second lever end 3042. Moreover, the fulcrum 3043 is protruded downwardly from the lever body 3040. Consequently, the fulcrum 3043 is contacted with the membrane circuit board 32, or the fulcrum 3043 is penetrated through the membrane circuit board 32 and contacted with the base plate 31A. In this embodiment, the lever body 3040 of the lever structure 304 is a sheet-shaped structure with an opening 30401. The elastic element 303 is penetrated through the opening 30401. Preferably but not exclusively, the lever structure 304 is made of metallic material, and the first lever end 3041 is higher than the second lever end 3042.

Moreover, the keycap 301A comprises fixed hooks 3011 and movable hooks 3012. The fixed hooks 3011 and the movable hooks 3012 are disposed on the bottom surface of the keycap 301A. In an embodiment, the connecting element 302A is a scissors-type connecting element. Moreover, the connecting element 302A comprises a first frame 3021 and a second frame 3022A. The second frame 3022A is pivotally coupled to the first frame 3021. The first frame 3021 is an inner frame, and the second frame 3022A is an outer frame. The first frame 3021 has a hollow portion 30213. The lever structure 304 is disposed within the hollow portion 30213.

The base plate 31A comprises a plate body 312, plural first base plate hooks 313 and plural second base plate hooks 314. The plate body 312 is located under the membrane circuit board 32. The plural first base plate hooks 313 and the plural second base plate hooks 314 are protruded upwardly from the plate body 312 and penetrated through the membrane circuit board 32. The first end 30211 of the first frame 3021 is connected with the corresponding fixed hook 3011 of the keycap 301A. The second end 30212 of the first frame 3021 is connected with the second base plate hook 314 of the base plate 31A. The first end 30221 of the second frame 3022A is connected with the corresponding first base plate hook 313 of the base plate 31A. The second end 30222 of the second frame 3022A is connected with the movable hook 3012 of the keycap 301A. Due to the above structure, the first frame 3021 and the second frame 3022A can be swung relative to each other. Consequently, the first frame 3021 and the second frame 3022A are switched from a stacked state to an open-scissors state or switched from the open-scissors state to the stacked state. The connecting relationships between the connecting element 302A, the base plate 31A and the keycap 301A are presented herein for purpose of illustration and description only.

The operations of the keyboard device 3A will be described as follows. While the keycap 301A of any key structure 30A is depressed and moved downwardly relative to the base plate 31A, the first frame 3021 and the second frame 3022A of the connecting element 302A are switched from the open-scissors state to the stacked state. Moreover, as the keycap 301A is moved downwardly to compress the elastic element 303, the corresponding upper contact 3222 is pushed and triggered by the contacting part 3031 of the elastic element 303. Consequently, the corresponding upper contact 3222 is contacted with the corresponding lower contact 3232 through the corresponding perforation 3241. In such way, the corresponding membrane switch 321 is electrically conducted, and the keyboard device 3A generates a corresponding key signal.

When the keycap 301A of the key structure 30A is no longer depressed, the keycap 301A is moved upwardly relative to the base plate 31A in response to an elastic force of the elastic element 303. Meanwhile, the first frame 3021 and the second frame 3022A are switched from the stacked state to the open-scissors state again, and the keycap 301A is returned to its original position.

While the keycap 301A of the key structure 30A is depressed and moved downwardly relative to the base plate 31A, the first end 30211 of the first frame 3021 is moved downwardly to push the first lever end 3041 of the lever structure 304. Consequently, the first lever end 3041 of the lever structure 304 is swung in a direction D11. According to the principle of leverage, the second lever end 3042 of the lever structure 304 is swung in a direction D12. Consequently, while the keycap 301A is moved downwardly, the second lever end 3042 of the lever structure 304 is moved upwardly to collide with the keycap 301A. Consequently, the operating sound and the operating feedback are generated.

From the above descriptions, the keyboard device 3A is equipped with the membrane circuit board 32. Consequently, the keyboard device 3A is slim and has reduced fabricating cost. The key structure 30A comprises the lever structure 304. As the keycap 301A is moved downwardly, the lever structure 304 is moved upwardly to collide with the keycap 301A. Consequently, the keyboard device 3A provides the operating sound and the operating feedback like a mechanical switch. In other words, the keyboard device of the present invention is industrially valuable. The keyboard device is suitably applied to an electronic sports product, e.g., a keyboard device for the electronic sports game.

Figure 11:
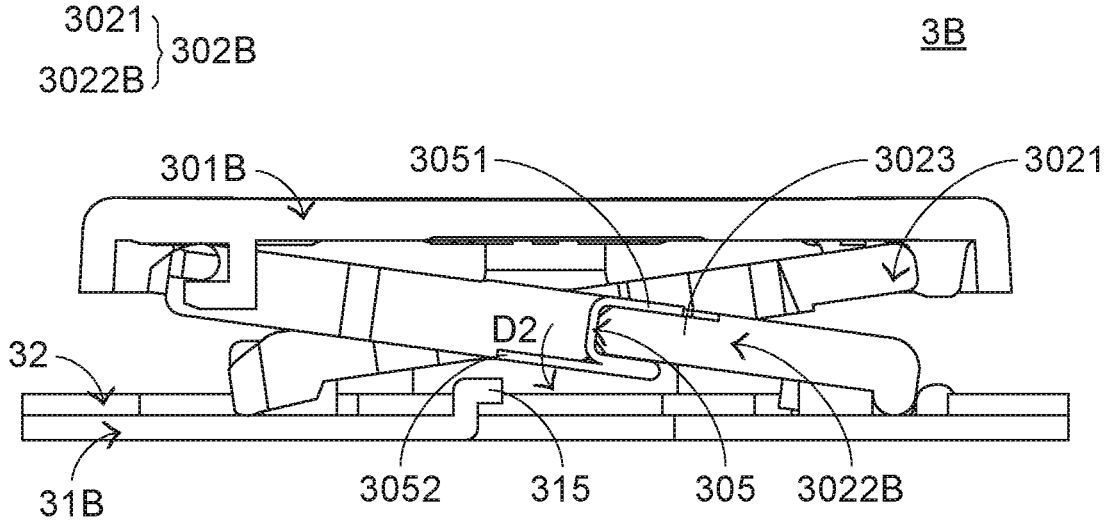
FIG. 11 is a schematic cross-sectional view illustrating a portion of a keyboard device according to a second embodiment of the present invention.
Figure 12:
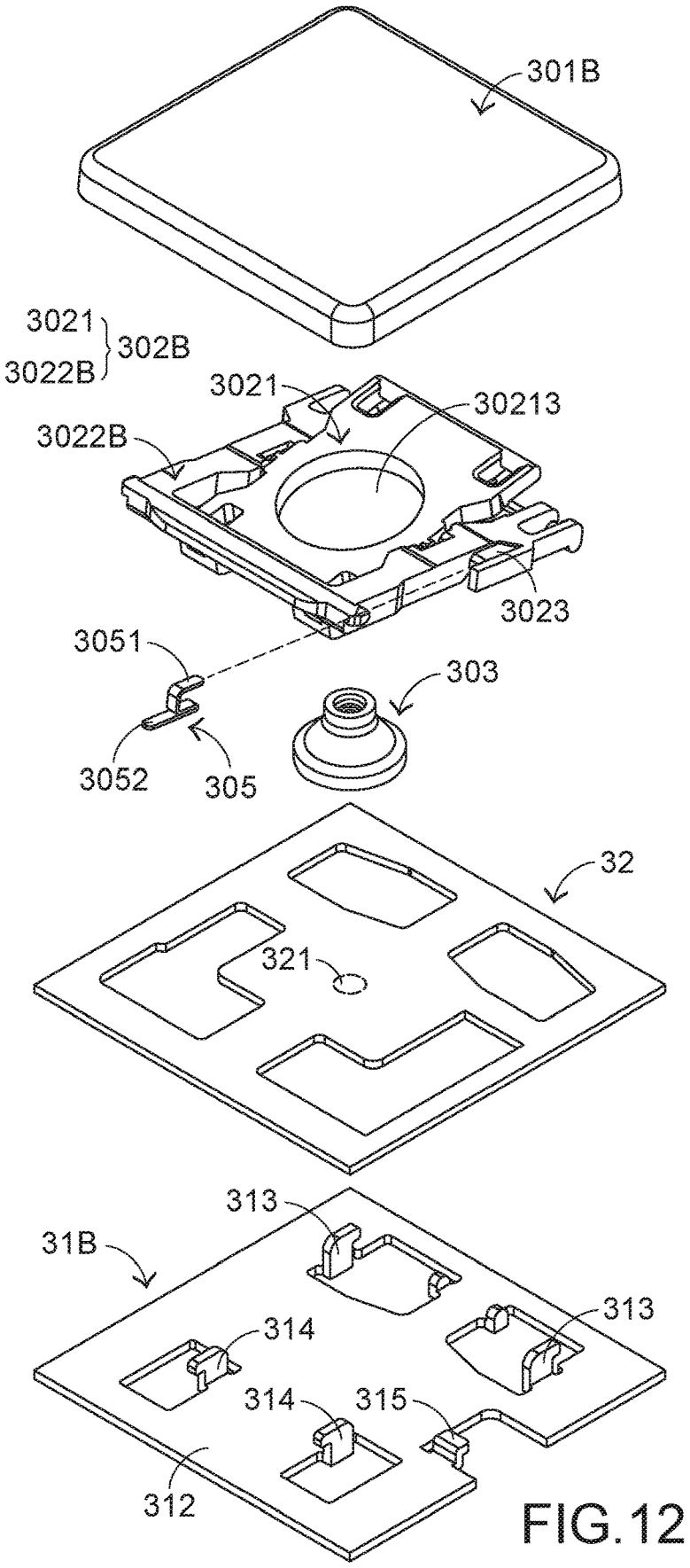
FIG. 12 is a schematic exploded view illustrating a portion of the keyboard device as shown in FIG. 11.

Please refer to FIGS. 11 and 12. FIG. 11 is a schematic cross-sectional view illustrating a portion of a keyboard device according to a second embodiment of the present invention. FIG. 12 is a schematic exploded view illustrating a portion of the keyboard device as shown in FIG. 11. The structures and functions of the components of the keyboard device 3B which are identical to those of the first embodiment are not redundantly described herein. In comparison with the first embodiment, the key structure 30B is not equipped with the lever structure 304, and the key structure 30B further comprises a resilience element 305. An end of the resilience element 305 is fixedly connected with the connecting element 302B. Moreover, the base plate 31B further comprises a clicked part 315. The clicked part 315 is protruded upwardly from the plate body 312 and penetrated through the membrane circuit board 32. Preferably but not exclusively, the resilience element 305 is made of metallic material.

In an embodiment, the connecting element 302B further comprises a fixing part 3023. The fixing part 3023 is disposed on an outer surface of the second frame 3022B. A first end 3051 of the resilience element 305 is U-shaped. The fixing part 3023 of the connecting element 302B is clamped by the first end 3051 of the resilience element 305, and thus the resilience element 305 is fixed on the second frame 3022B. In this embodiment, the end of the resilience element 305 is fixedly connected with the connecting element 302B. It is noted that numerous modifications and alterations may be made while retaining the teachings of the invention.

Figure 13:
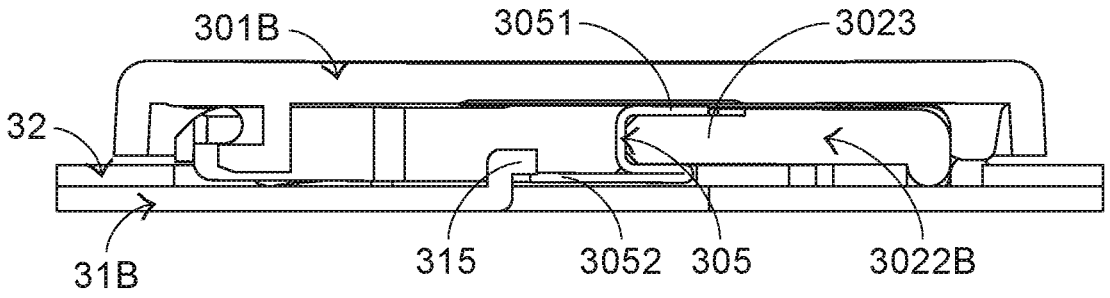
FIG. 13 is a schematic cross-sectional view illustrating a portion of the keyboard device as shown in FIG. 11, in which a keycap of the key structure is depressed.

While the keycap 301B of any key structure 30B is depressed and moved downwardly relative to the base plate 31B, the connecting element 302B is pushed by the keycap 301B. Consequently, the connecting element 302B is switched from the open-scissors state to the stacked state. As the connecting element 302B is moved downwardly, the resilience element 305 is swung in a direction D2. Since a second end 3052 of the resilience element 305 collides with the clicked part 315 of the base plate 31B, the interference between the second end 3052 of the resilience element 305 and the base plate 31B is generated. Meanwhile, the operating sound and the operating feedback are generated. FIG. 13 is a schematic cross-sectional view illustrating a portion of the keyboard device as shown in FIG. 11, in which a keycap of the key structure is depressed. Due to the interference between the second end 3052 of the resilience element 305 and the base plate 31B, the second end 3052 of the resilience element 305 is subjected to elastic deformation and transferred across the clicked part 315.

From the above descriptions, the keyboard device 3B is equipped with the membrane circuit board 32. Consequently, the keyboard device 3B is slim and has reduced fabricating cost. The key structure 30B comprises the resilience element 305. As the keycap 301B is moved downwardly, the resilience element 305 is moved upwardly to collide with the base plate 31B. Consequently, the keyboard device 3B provides the operating sound and the operating feedback like a mechanical switch. In other words, the keyboard device of the present invention is industrially valuable. The keyboard device is suitably applied to an electronic sports product, e.g., a keyboard device for the electronic sports game.

Figure 14:
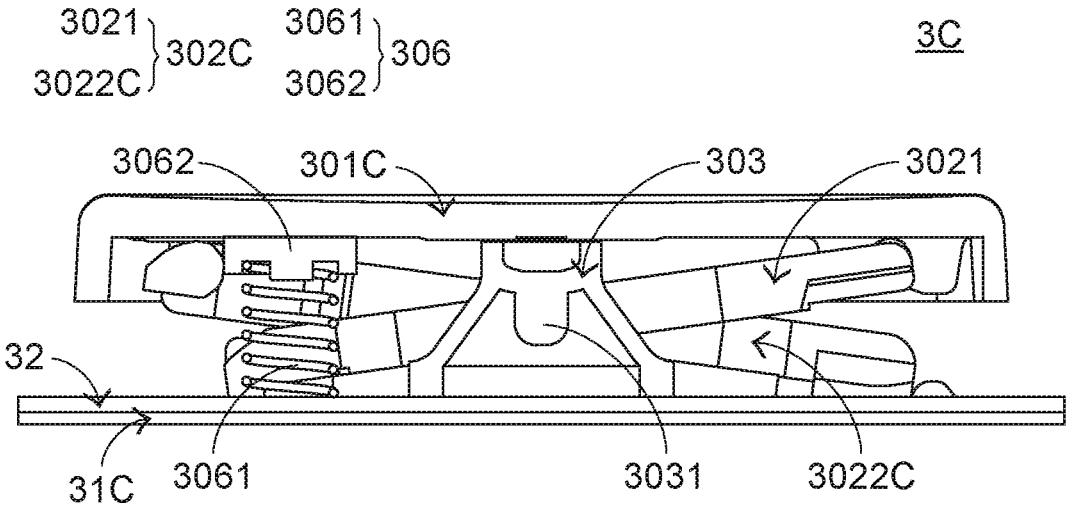
FIG. 14 is a schematic cross-sectional view illustrating a portion of a keyboard device according to a third embodiment of the present invention.
Figure 15:
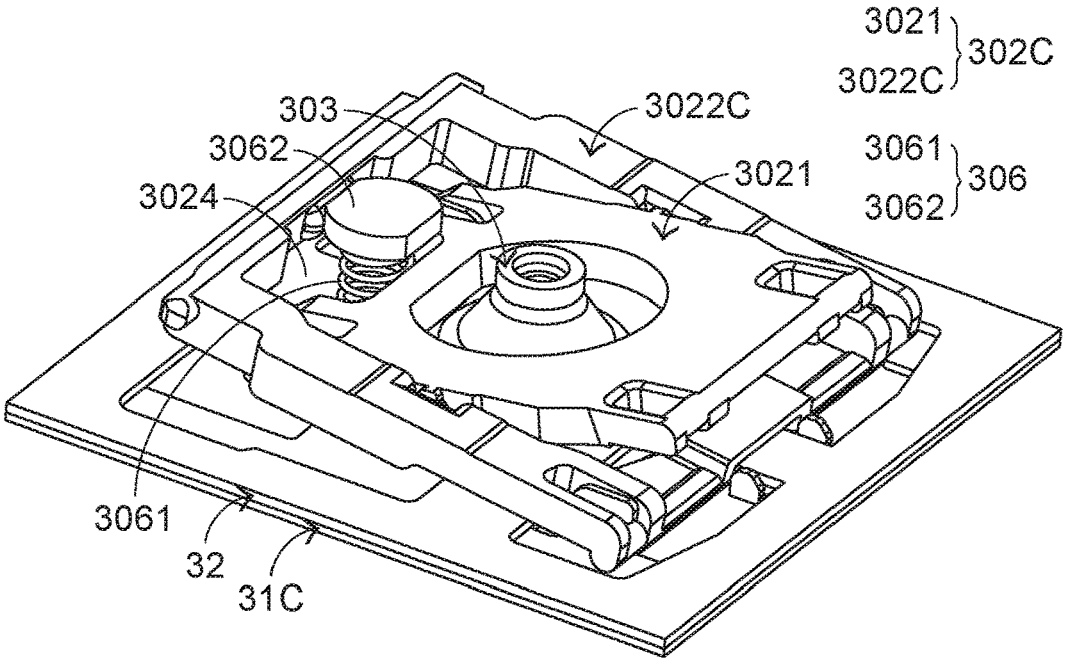
FIG. 15 is a schematic perspective view illustrating a portion of the keyboard device as shown in FIG. 14.
Figure 16:
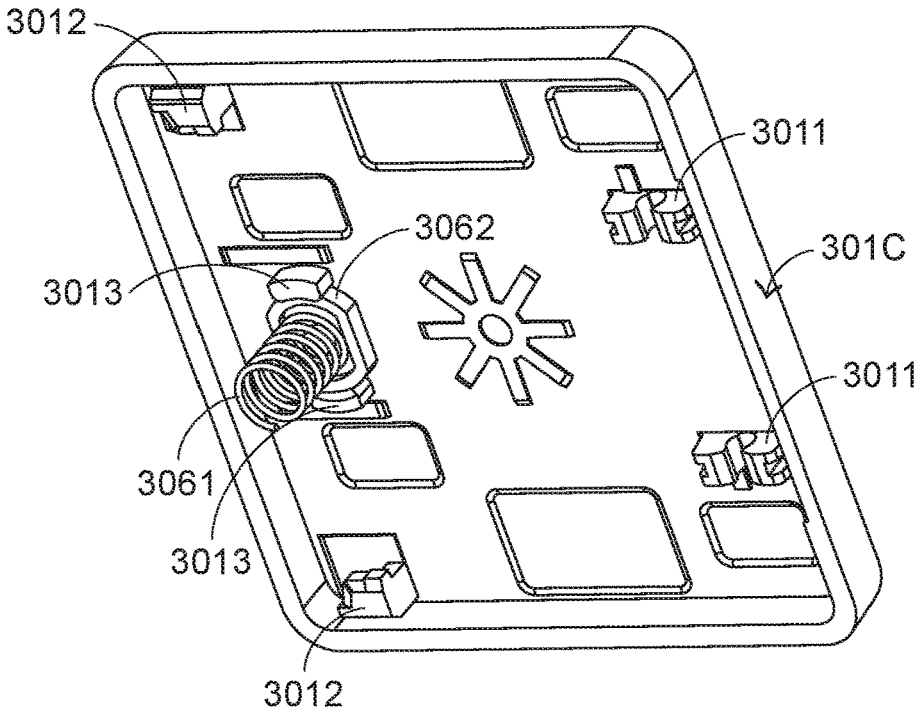
FIG. 16 is a schematic perspective view illustrating a keycap and an interference structure of the keyboard device as shown in FIG. 14.
Figure 17:
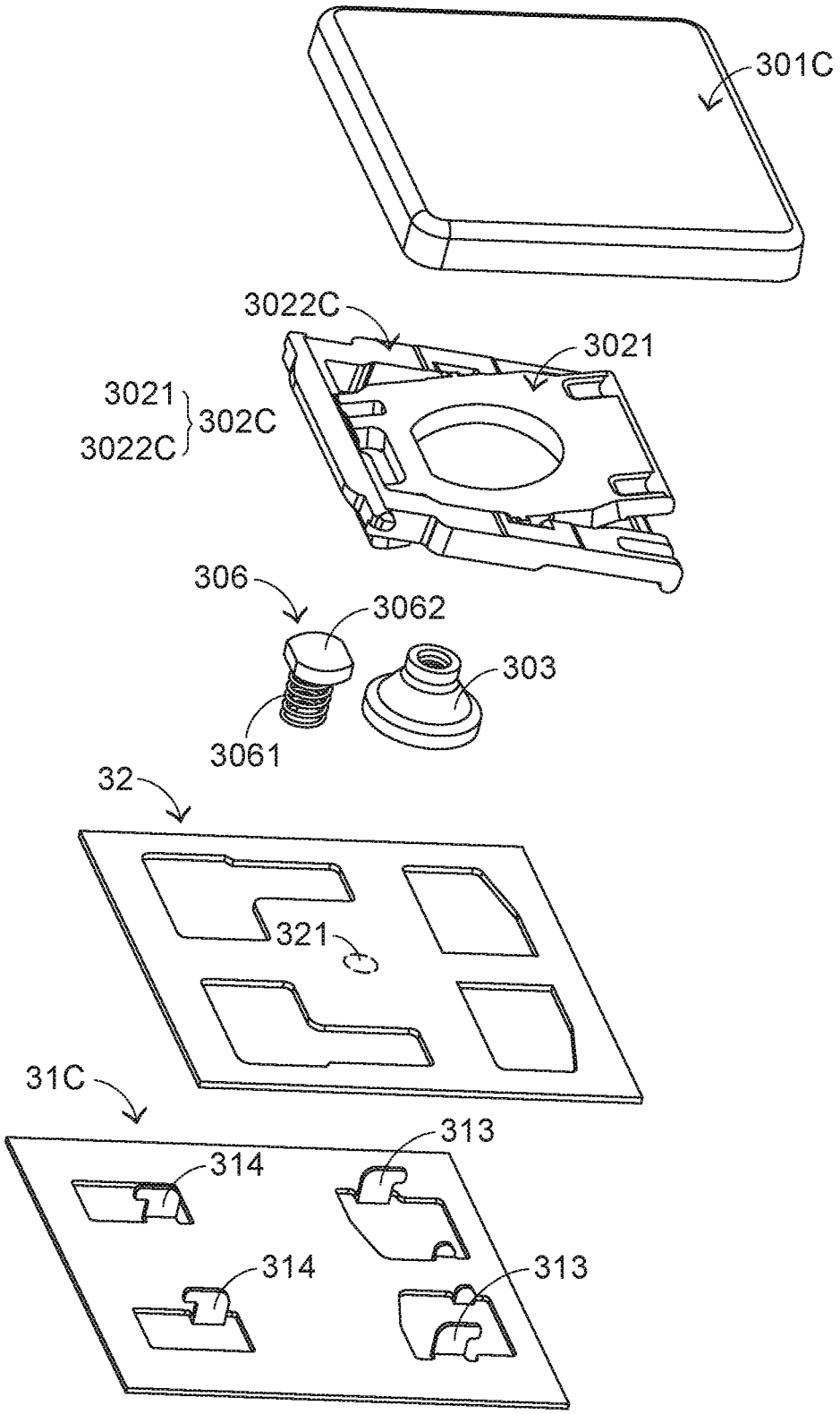
FIG. 17 is a schematic exploded view illustrating a portion of the keyboard device as shown in FIG. 14.

Please refer to FIGS. 14, 15, 16 and 17. FIG. 14 is a schematic cross-sectional view illustrating a portion of a keyboard device according to a third embodiment of the present invention. FIG. 15 is a schematic perspective view illustrating a portion of the keyboard device as shown in FIG. 14. FIG. 16 is a schematic perspective view illustrating a keycap and an interference structure of the keyboard device as shown in FIG. 14. FIG. 17 is a schematic exploded view illustrating a portion of the keyboard device as shown in FIG. 14. The structures and functions of the components of the keyboard device 3C which are identical to those of the first embodiment are not redundantly described herein. In comparison with the first embodiment, the key structure 30C is not equipped with the lever structure 304, and the key structure 30C further comprises an interference structure 306. The interference structure 306 is located under the keycap 301C. Moreover, a position-limiting structure 3013 is disposed on a bottom surface of the keycap 301C.

The interference structure 306 comprises a spring part 3061 and a head part 3062. A first end of the spring part 3061 is contacted with the membrane circuit board 32, or the first end of the spring part 3061 is penetrated through the membrane circuit board 32 and contacted with the base plate 31C. A second end of the spring part 3061 is connected with the head part 3062. In response to an elastic force of the spring part 3061, the head part 3062 is contacted with the keycap 301C. That is, the interference structure 306 is arranged between the keycap 301C and the membrane circuit board 32, or the interference structure 306 is clamped between the keycap 301C and the base plate 31C. When the head part 3062 is contacted with the keycap 301C, the position-limiting structure 3013 is contacted with an outer periphery of the head part 3062. Consequently, the movable range of the head part 3062 along a horizontal direction is limited (see FIG. 16). Moreover, as shown in FIG. 15, the spring part 3061 is received within an accommodation space 3024 between an outer side of the first frame 3021 and an inner side of the second frame 3022C. Preferably but not exclusively, the spring part 3061 is made of metallic material, and the head part 3062 is made of plastic material.

While the keycap 301C of any key structure 30C is depressed and moved downwardly relative to the base plate 31C, the connecting element 302C is pushed by the keycap 301C. Consequently, the connecting element 302C is switched from the open-scissors state to the stacked state. As the connecting element 302C is moved downwardly, the head part 3062 of the interference structure 306 is moved downwardly to collide with the connecting element 302C. Due to the interference between the head part 3062 of the interference structure 306 and the connecting element 302C, the operating sound and the operating feedback are generated.

From the above descriptions, the keyboard device 3C is equipped with the membrane circuit board 32. Consequently, the keyboard device 3C is slim and has reduced fabricating cost. The key structure 30C comprises the interference structure 306. As the keycap 301C is moved downwardly, the interference structure 306 is moved downwardly to collide with the connecting element 302C. Consequently, the keyboard device 3C provides the operating sound and the operating feedback like a mechanical switch. In other words, the keyboard device of the present invention is industrially valuable. The keyboard device is suitably applied to an electronic sports product, e.g., a keyboard device for the electronic sports game.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a membrane circuit board comprising a membrane switch;

a base plate located under the membrane circuit board; and a key structure comprising:

a keycap located over the membrane circuit board;

a connecting element connected between the base plate and the keycap, wherein the keycap is movable upwardly or downwardly relative to the base plate through the connecting element; and a lever structure located under the keycap, and comprising a lever body, a first lever end, a second lever end and a fulcrum, wherein the first lever end, the second lever end and the fulcrum are connected with the lever body, the first lever end is protruded upwardly from a first lateral side of the lever body, the second lever end is protruded upwardly from a second lateral side of the lever body, the fulcrum is arranged between the first lever end and the second lever end, and the fulcrum is protruded downwardly from the lever body and contacted with the membrane circuit board or the base plate, wherein while the keycap is depressed and the connecting element is moved downwardly to push the first lever end, the second lever end is moved upwardly to collide with the keycap.

2. The keyboard device according to claim 1, wherein the lever body is sheet-shaped structure with an opening, and an elastic element is penetrated through the opening, wherein the elastic element is arranged between the keycap and the membrane circuit board, and the elastic element comprises a contacting part, wherein while the keycap is depressed, the elastic element is compressed and the membrane switch is pushed by the contacting part, wherein when the keycap is not depressed, the keycap is returned to an original position in response to an elastic force of the elastic element.

3. The keyboard device according to claim 1, wherein the connecting element comprises a hollow portion, and the lever structure is disposed within the hollow portion.

4. The keyboard device according to claim 1, wherein the first lever end is higher than the second lever end.

5. The keyboard device according to claim 1, wherein the lever structure is made of metallic material.

6. The keyboard device according to claim 1, wherein the connecting element comprises:

a first frame, wherein a first end of the first frame is connected with the keycap, and a second end of the first frame is connected with the base plate; and a second frame connected with the first frame and swung relative to the first frame, wherein a first end of the second frame is connected with the base plate, and a second end of the second frame is connected with the keycap.

7. The key structure according to claim 1, wherein the membrane circuit board further comprises an upper film layer and a lower film layer, wherein a first circuit pattern is formed on the upper film layer, a second circuit pattern is formed on the lower film layer, the first circuit pattern comprises an upper contact, and the second circuit pattern comprises a lower contact, wherein the upper contact and the lower contact are separated from each other by a spacing distance and collectively defined as the membrane switch.

8. A keyboard device, comprising:

a membrane circuit board comprising a membrane switch;

a base plate located under the membrane circuit board; and a key structure comprising:

a keycap located over the membrane circuit board;

a connecting element connected between the base plate and the keycap, wherein the keycap is movable upwardly or downwardly relative to the base plate through the connecting element, wherein the connecting element comprises a fixing part, and the fixing part is disposed on an outer surface of the connecting element; and a resilience element, wherein a first end part of the resilience element is fixedly connected with the connecting element, wherein while the keycap is depressed to push the connecting element, a second end part of the resilience element is moved downwardly to collide with the base plate, wherein the first end part of the resilience element s U-shaped, and the fixing part of the connecting element is clamped by the first end part of the resilience element, so that the resilience element is fixed on the connecting element.

9. The keyboard device according to claim 8, wherein the connecting element further comprises:

a first frame, wherein a first end of the first frame is connected with the keycap, and a second end of the first frame is connected with the base plate; and a second frame connected with the first frame and swung relative to the first frame, wherein a first end of the second frame is connected with the base plate, and a second end of the second frame is connected with the keycap, wherein the fixing part is disposed on an outer surface of the second frame.

10. The keyboard device according to claim 8, wherein the key structure further comprises an elastic element, wherein the elastic element is arranged between the keycap and the membrane circuit board, and the elastic element comprises a contacting part, wherein while the keycap is depressed, the elastic element is compressed and the membrane switch is pushed by the contacting part, wherein when the keycap is not depressed, the keycap is returned to an original position in response to an elastic force of the elastic element.

11. The keyboard device according to claim 8, wherein the resilience element is made of metallic material.

12. A keyboard device, comprising:

a membrane circuit board comprising a membrane switch;

a base plate located under the membrane circuit board, wherein the base plate comprises a plate body and a clicked part, wherein the plate body is located under the membrane circuit board, and the clicked part is protruded upwardly from the plate body and penetrated through the membrane circuit board; and a key structure comprising:

a keycap located over the membrane circuit board;

a connecting element connected between the base plate and the keycap, wherein the keycap is movable upwardly or downwardly relative to the base plate through the connecting element; and a resilience element, wherein a first end part of the resilience element is fixedly connected with the connecting element, wherein while the keycap is depressed to push the connecting element, a second end part of the resilience element is moved downwardly to collide with the base plate, wherein while the keycap is depressed to push the connecting element, the second end part of the resilience element is moved downwardly to collide with the clicked part.

13. The keyboard device according to claim 12, wherein the base plate further comprises a first base plate hook and a second base plate hook, wherein the first base plate hook and the second base plate hook are protruded upwardly from the plate body and penetrated through the membrane circuit board, wherein the first base plate hook is connected with a second frame of the connecting element, and the second base plate hook is connected with a first frame of the connecting element.

14. The keyboard device according to claim 12, wherein the key structure further comprises an elastic element, wherein the elastic element is arranged between the keycap and the membrane circuit board, and the elastic element comprises a contacting part, wherein while the keycap is depressed, the elastic element is compressed and the membrane switch is pushed by the contacting part, wherein when the keycap is not depressed, the keycap is returned to an original position in response to an elastic force of the elastic element.

15. The keyboard device according to claim 12, wherein the resilience element is made of metallic material.

* * * * *